US008209168B2

(12) United States Patent
Yoshida

(10) Patent No.: US 8,209,168 B2
(45) Date of Patent: Jun. 26, 2012

(54) STEREO DECODER THAT CONCEALS A LOST FRAME IN ONE CHANNEL USING DATA FROM ANOTHER CHANNEL

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1299 days.

(21) Appl. No.: 11/628,045

(22) PCT Filed: May 20, 2005

(86) PCT No.: PCT/JP2005/009252

§ 371 (c)(1),
(2), (4) Date: Nov. 30, 2006

(87) PCT Pub. No.: WO2005/119950

PCT Pub. Date: Dec. 15, 2005

(65) Prior Publication Data

US 2008/0065372 A1 Mar. 13, 2008

(30) Foreign Application Priority Data

Jun. 2, 2004 (JP) ..... 2004-165016

(51) Int. Cl.
*G10L 19/00* (2006.01)
*G10L 19/14* (2006.01)
*G10L 21/02* (2006.01)

(52) U.S. Cl. ..... 704/218; 704/216; 704/211; 704/228

(58) Field of Classification Search ..... 704/218, 704/E19.003, E19.005
See application file for complete search history.

(56) References Cited

U.S. PATENT DOCUMENTS 4,821,260 A * 4/1989 Klank et al. ..... 370/345
5,596,678 A * 1/1997 Wigren et al. ..... 704/228
5,862,518 A * 1/1999 Nomura et al. ..... 704/214
5,890,118 A * 3/1999 Kagoshima et al. ..... 704/265

(Continued)

FOREIGN PATENT DOCUMENTS

EP 1094630 4/2001

(Continued)

OTHER PUBLICATIONS

Supplementary European Search Report dated Aug. 13, 2007.

(Continued)

*Primary Examiner* — Talivaldis Ivars Smits
*Assistant Examiner* — Jesse Pullias
(74) *Attorney, Agent, or Firm* — Dickinson Wright PLLC

(57) ABSTRACT

An audio data transmitting/receiving apparatus for realizing a high-quality frame compensation in audio communications. In an audio data transmitting apparatus (10), a delay part (104) subjects multi-channel audio data to a delay process that delays the L-ch encoded data relative to the R-ch encoded data by a predetermined delay amount. A multiplexing part (106) multiplexes the audio data as subjected to the delay process. A transmitting part (108) transmits the audio data as multiplexed. In an audio data receiving apparatus (20), a separating part (114) separates, for each channel, the audio data received from the audio data transmitting apparatus (10). A decoding part (118) decodes, for each channel, the audio data as separated. If there has occurred a loss or error in the audio data as separated, then a frame compensating part (120) uses one of the L-ch and R-ch encoded data to compensate for the loss or error in the other encoded data.

5 Claims, 8 Drawing Sheets

U.S. PATENT DOCUMENTS

| | | | | |
|---|---|---|---|---|
| 5,917,835 | A * | 6/1999 | Barrett et al. | 714/755 |
| 5,928,379 | A * | 7/1999 | Hattori | 714/807 |
| 6,055,497 | A * | 4/2000 | Hallkvist et al. | 704/228 |
| 6,327,689 | B1 * | 12/2001 | Tian | 714/751 |
| 6,535,717 | B1 | 3/2003 | Matsushima et al. | |
| 6,549,886 | B1 * | 4/2003 | Partalo | 704/270.1 |
| 6,985,856 | B2 * | 1/2006 | Wang et al. | 704/226 |
| 7,411,985 | B2 * | 8/2008 | Lee et al. | 370/352 |
| 2003/0177011 | A1 * | 9/2003 | Yasuda et al. | 704/265 |

FOREIGN PATENT DOCUMENTS

| | | |
|---|---|---|
| EP | 1394973 | 3/2004 |
| EP | 1501227 | 1/2005 |
| JP | 10327116 | 12/1998 |
| JP | 11284582 | 10/1999 |
| JP | 11313011 | 11/1999 |
| JP | 2001144733 | 5/2001 |
| WO | 0018057 | 3/2000 |

OTHER PUBLICATIONS

PCT International Search Report dated Jun. 21, 2005.

3GPP TS 26.091 v5.0.0 (Jun. 2002); 3rd Generation Partnership Project; Technical Specification Group Services and System Aspects; Mandatory Speech Codec Speech processing functions; Adaptive Multi-Rate (AMR) speech codec; Error concealment of lost frames; (Release 5), pp. 1-13.

J. Sjoberg, et al.; "Real-Time Transport Protocol (RTP) Payload Format and File Storage Format for the Adaptive Multi-Rate (AMR) and Adaptive Multi-Rate Wideband (AMR-WB) Audio Codecs," Network Working Group Request for Comments: 3267, Category: Standards Track, Jun. 2002, pp. 1-43.

* cited by examiner

STEREO DECODER THAT CONCEALS A LOST FRAME IN ONE CHANNEL USING DATA FROM ANOTHER CHANNEL

TECHNICAL FIELD

The present invention relates to a voice data transmitting/receiving apparatus and voice data transmitting/receiving method, and more particularly to a voice data transmitting/receiving apparatus and voice data transmitting/receiving method used in a voice communication system in which concealment processing is performed for erroneous voice data and lost voice data.

BACKGROUND ART

In voice communications on an IP (Internet Protocol) network or radio communication network, voice data may not be able to be received on the receiving side, or may be received containing errors, due to IP packet loss, radio transmission errors, or the like. Therefore, in voice communication systems, processing is generally performed to conceal erroneous or lost voice data.

On the transmitting side of a typical voice communication system—that is, in a voice data transmitting apparatus—a voice signal constituting an input original signal is coded as voice data, multiplexed (packetized), and transmitted to a destination apparatus. Normally, multiplexing is performed with one voice frame as one transmission unit. With regard to multiplexing, Non-patent Document 1, for example, stipulates an IP packet network voice data format for 3GPP (The 3rd Generation Partnership Project) standard voice codec methods AMR (Adaptive Multi-Rate) and AMR-WB (Adaptive Multi-Rate Wideband).

On the receiving side—that is, in a voice data receiving apparatus—if there is loss or an error in received voice data, the voice signal in a lost or erroneous voice frame is restored by means of concealment processing using, for example, voice data (coded data) in a voice frame received in the past or a decoded voice signal decoded by using the voice data. With regard to voice frame concealment processing, Non-patent Document 2, for example, discloses an AMR frame concealment method.

Voice processing operations in an above-described voice communication system will now be outlined using FIG. 1. The sequence numbers ( . . . , n−2, n−1, n, n+1, N+2, . . . ) in FIG. 1 are frame numbers assigned to individual voice frames. On the receiving side, this frame number order is followed in decoding a voice signal and outputting decoded voice as a sound wave. Also, as shown in the same figure, coding, multiplexing, transmission, separation, and decoding are performed on an individual voice frame basis. For example, if frame n is lost, a voice frame received in the past (for example, frame n−1 or frame n−2) is referenced, and frame concealment processing is performed for frame n.

With the increasing use of broadband networks and multimedia communications in recent years, there has been a trend of higher voice quality in voice communications. As part of this trend, there is a demand for voice signals to be coded and transmitted not as monaural signals but as stereo signals. With regard to this demand, Non-patent Document 1 includes stipulations concerning multiplexing when voice data is multi-channel data (for example, stereo voice data). According to this document, when voice data is 2-channel data, for example, left-channel (L-ch) voice data and right-channel (R-ch) voice data corresponding to the same time are multiplexed.

Non-patent Document 1: "Real-Time Transfer Protocol (RTP) Payload Format and File Storage Format for the Adaptive Multi-Rate (AMR) and Adaptive Multi-Rate Wideband (AMR-WB) Audio Codecs", IETF RFC3267

Non-patent Document 2: "Mandatory Speech Codec speech processing functions; AMR Speech Codecs; Error concealment of lost frames", 3rd Generation Partnership Project, TS26.091

DISCLOSURE OF INVENTION

Problems to be Solved by the Invention

However, with a conventional voice data receiving apparatus and voice data receiving method, when concealment is performed for a lost or erroneous voice frame, a voice frame received prior to that voice frame is used, and therefore concealment performance may be inadequate, and there is a certain limit to the execution of faithful concealment on an input original signal. This is true whether the voice signal handled is monaural or stereo.

The present invention has been implemented taking into account the problems described above, and it is an object of the present invention to provide a voice data transmitting/receiving apparatus and voice data transmitting/receiving method that enable high-quality frame concealment to be implemented.

Means for Solving the Problems

A voice data transmitting apparatus of the present invention transmits a multi-channel voice data sequence containing a first data sequence corresponding to a first channel and a second data sequence corresponding to a second channel, and employs a configuration that includes: a delay section that executes delay processing that delays the first data sequence by a predetermined delay amount relative to the second data sequence on the voice data sequence; a multiplexing section that multiplexes the voice data sequence on which delay processing has been executed; and a transmitting section that transmits the multiplexed voice data sequence.

A voice data receiving apparatus of the present invention employs a configuration that includes: a receiving section that receives a multi-channel voice data sequence that contains a first data sequence corresponding to a first channel and a second data sequence corresponding to a second channel, wherein the multi-channel voice data sequence is multiplexed with the first data sequence delayed by a predetermined delay amount relative to the second data sequence; a separation section that separates the received voice data sequence on a channel-by-channel basis; and a decoding section that decodes the separated voice data sequence on a channel-by-channel basis; wherein the decoding section has a concealment section that, when loss or an error occurs in the separated voice data sequence, uses one data sequence of the first data sequence and the second data sequence to conceal the loss or error in the other data sequence.

A voice data transmitting method of the present invention transmits a multi-channel voice data sequence containing a first data sequence corresponding to a first channel and a second data sequence corresponding to a second channel, and includes: a delay step of executing delay processing that delays the first data sequence by a predetermined delay amount relative to the second data sequence on the voice data sequence; a multiplexing step of multiplexing the voice data sequence on which delay processing has been executed; and a transmitting step of transmitting the multiplexed voice data sequence.

A voice data receiving method of the present invention includes: a receiving step of receiving a multi-channel voice data sequence that contains a first data sequence corresponding to a first channel and a second data sequence corresponding to a second channel, wherein the multi-channel voice data sequence is multiplexed with the first data sequence delayed by a predetermined delay amount relative to the second data sequence; a separation step of separating the received voice data sequence on a channel-by-channel basis; and a decoding step of decoding the separated voice data sequence on a channel-by-channel basis; wherein the decoding step has a concealment step of, when loss or an error occurs in the separated voice data sequence, using one data sequence of the first data sequence and the second data sequence to conceal the loss or error in the other data sequence.

Advantageous Effect of the Invention

The present invention enables high-quality frame concealment to be implemented.

BEST MODE FOR CARRYING OUT THE INVENTION

Embodiments of the present invention will now be described in detail with reference to the accompanying drawings.

Embodiment 1

Figure 1:
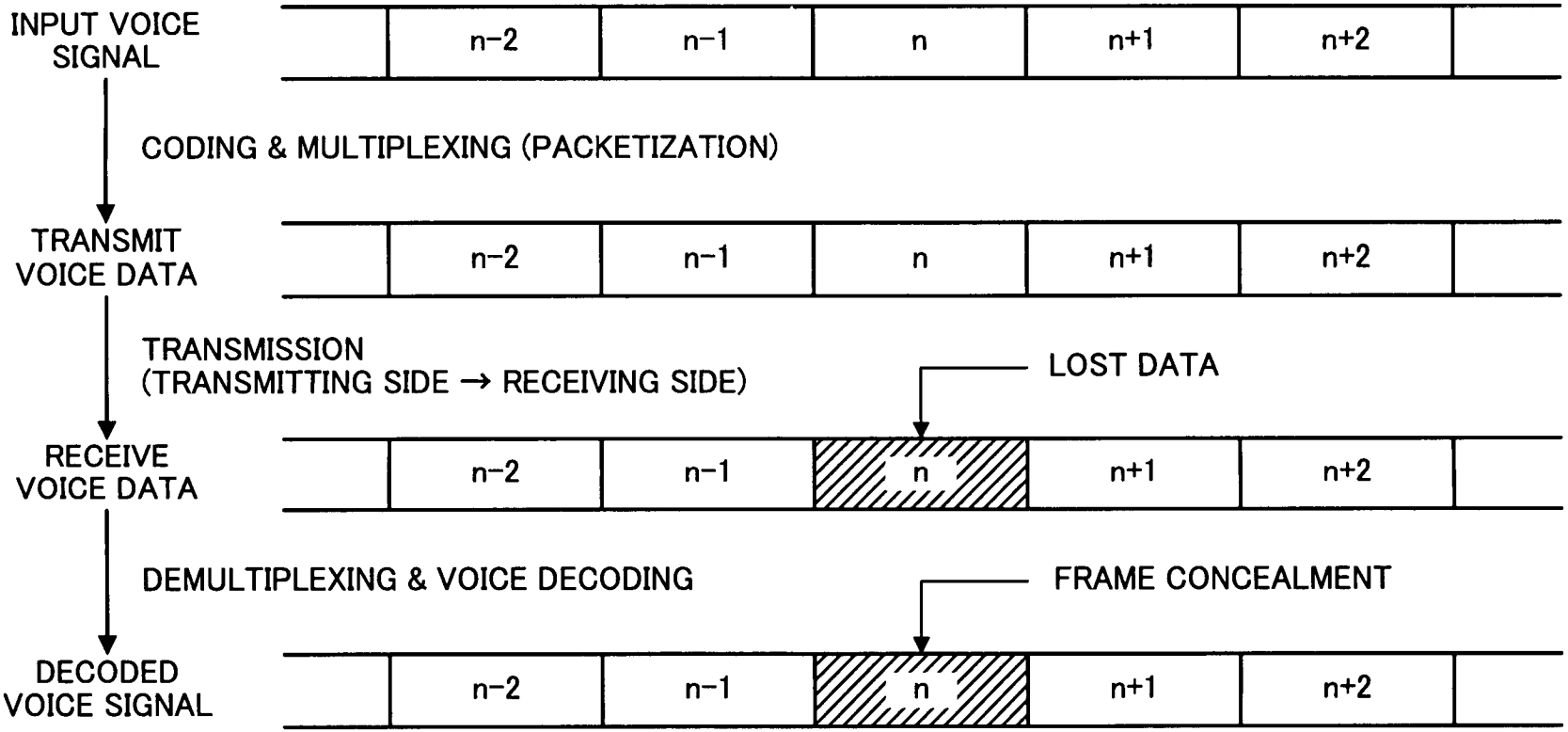
PRIOR ART FIG.1
FIG. 1 is a drawing for explaining an example of voice processing operations in a conventional voice communication system.
Figure 2A:
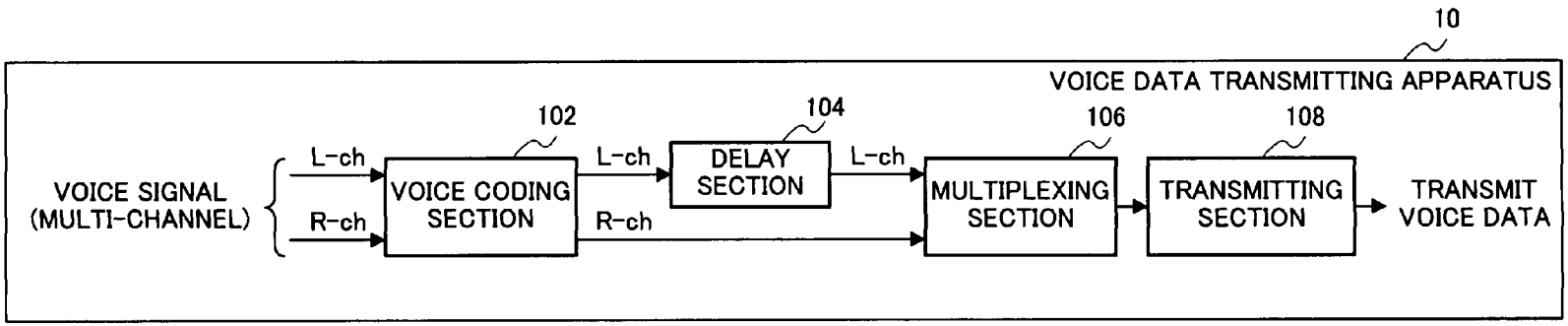
FIG. 2A is a block diagram showing the configuration of a voice data transmitting apparatus according to Embodiment 1 of the present invention.
Figure 2B:
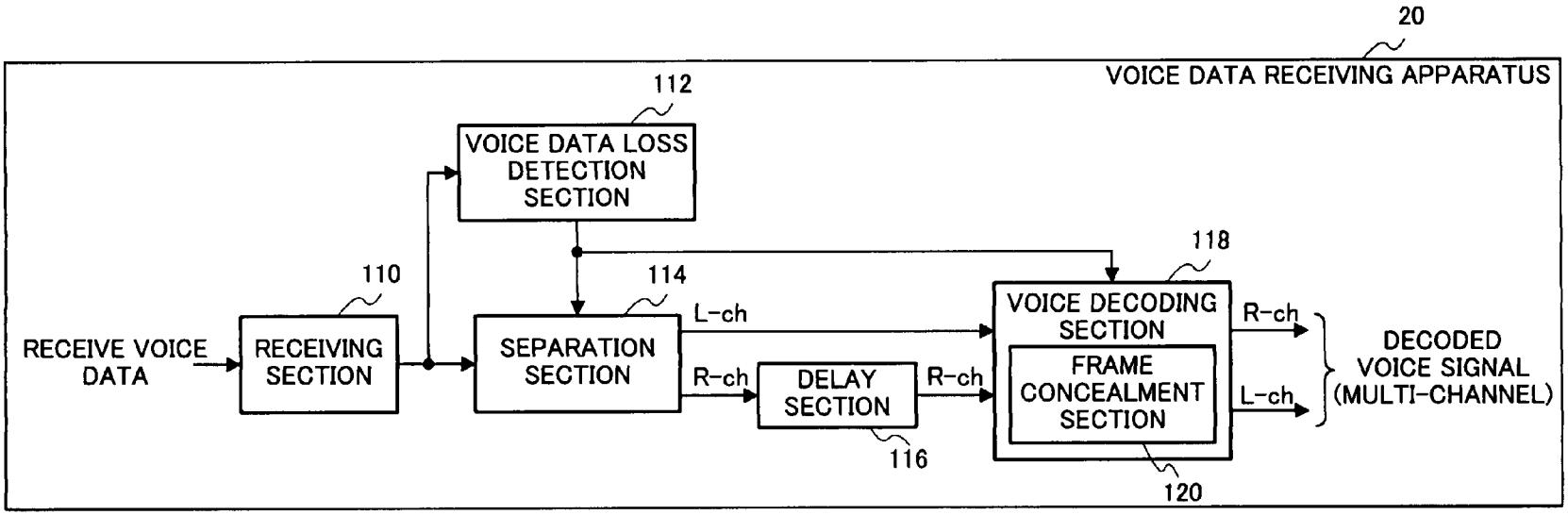
FIG. 2B is a block diagram showing the configuration of a voice data receiving apparatus according to Embodiment 1 of the present invention.

FIG. 2A and FIG. 2B are block diagrams showing the configurations of a voice data transmitting apparatus and voice data receiving apparatus respectively according to Embodiment 1 of the present invention. In this embodiment, a multi-channel voice signal input from the sound source side has two channels, a left channel (L-ch) and a right channel (R-ch)—that is to say, this voice signal is a stereo signal. Therefore, two processing systems for the left and right channels are provided in both voice data transmitting apparatus 10 and voice data receiving apparatus 20 shown in FIG. 2A and FIG. 2B respectively. However, the number of channels is not limited to two. If the number of channels is three or more, the same kind of operational effects as in this embodiment can be achieved by providing three or more processing systems on both the transmitting side and the receiving side.

Voice data transmitting apparatus 10 shown in FIG. 2A has a voice coding section 102, a delay section 104, a multiplexing section 106, and a transmitting section 108.

Voice coding section 102 encodes an input multi-channel voice signal, and outputs coded data. This coding is performed independently for each channel. In the following description, left-channel coded data is referred to as "L-ch coded data," and right-channel coded data is referred to as "R-ch coded data."

Delay section 104 outputs L-ch coded data from voice coding section 102 to multiplexing section 106 delayed by one voice frame. That is to say, delay section 104 is positioned after voice coding section 102. As delay processing follows voice coding processing, delay processing can be performed on data after it has been coded, and processing can be simplified compared with a case in which delay processing precedes voice coding processing.

The delay amount in delay processing performed by delay section 104 should preferably be set in voice frame units, but is not limited to one voice frame. However, with a system that includes voice data transmitting apparatus 10 and voice data receiving apparatus 20 of this embodiment, it is assumed that main uses will include not only streaming of audio data and the like but also real-time voice communication. Therefore, to prevent communication quality from being adversely affected by setting a large value for the delay amount, in this embodiment the delay amount is set beforehand to the minimum value—that is, one voice frame.

Also, in this embodiment, delay section 104 delays only L-ch coded data, but the way in which delay processing is executed on voice data is not limited to this. For example, delay section 104 may have a configuration whereby not only L-ch coded data but also R-ch coded data is delayed, and the difference in their delay amounts is set in voice frame units. Also, provision may be made for only R-ch to be delayed instead of L-ch.

Multiplexing section 106 packetizes multi-channel voice data by multiplexing L-ch coded data from delay section 104 and R-ch coded data from voice coding section 102 in a predetermined format (for example, the same kind of format as in the prior art). That is to say, in this embodiment, L-ch coded data having frame number N, for example, is multiplexed with R-ch coded data having frame number N+1.

Transmitting section 108 executes transmission processing determined beforehand according to the transmission path to voice data receiving apparatus 20 on voice data from multiplexing section 106, and transmits the voice data to voice data receiving apparatus 20.

Figure 3:
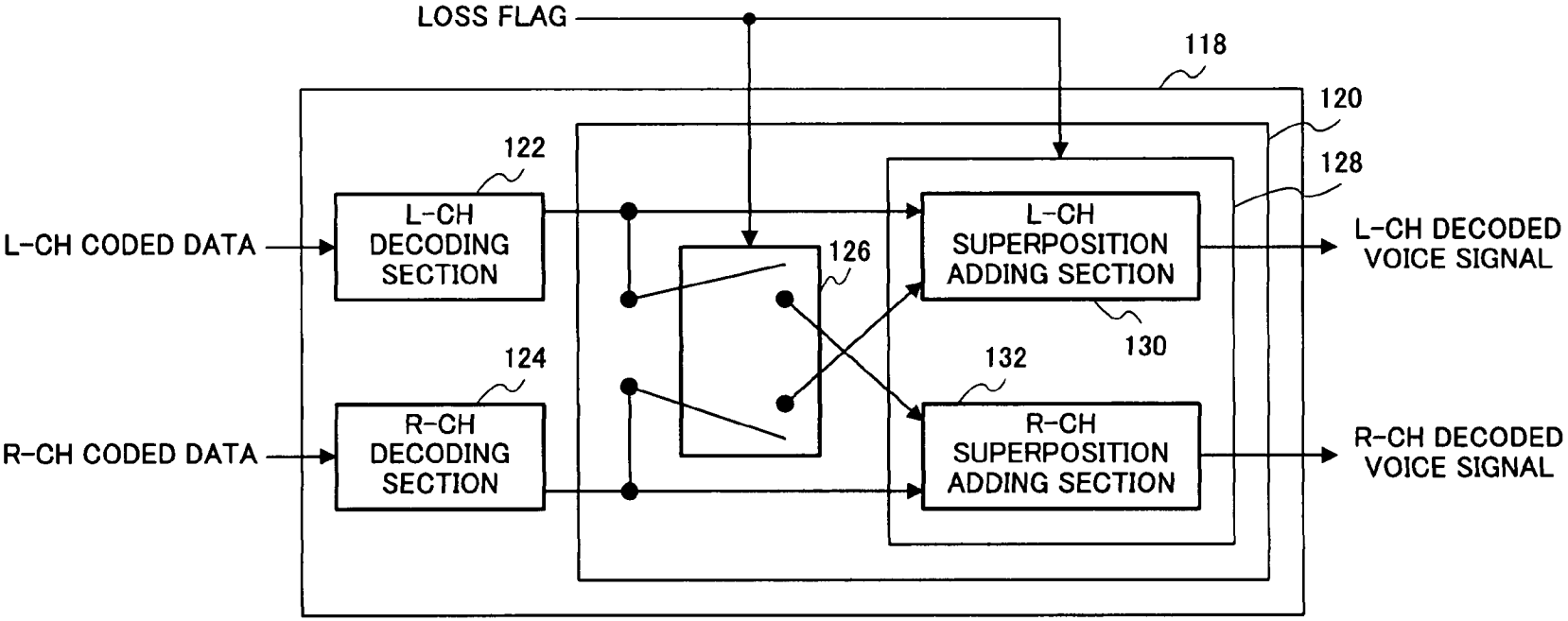
FIG. 3 is a block diagram showing the internal configuration of a voice decoding section in a voice data receiving apparatus according to Embodiment 1 of the present invention.

On the other hand, voice data receiving apparatus 20 shown in FIG. 2B has a receiving section 110, a voice data loss detection section 112, a separation section 114, a delay section 116, and a voice decoding section 118. Voice decoding section 118 has a frame concealment section 120. FIG. 3 is a block diagram showing the configuration of voice decoding section 118 in greater detail. In addition to frame concealment section 120, voice decoding section 118 has an L-ch decoding section 122 and R-ch decoding section 124. In this embodiment, frame concealment section 120 also has a switching section 126 and a superposition adding section 128, and superposition adding section 128 has an L-ch superposition adding section 130 and R-ch superposition adding section 132.

Receiving section 110 executes predetermined reception processing on receive voice data received from voice data transmitting apparatus 10 via a transmission path.

Voice data loss detection section 112 detects whether or not loss or an error (hereinafter "loss or an error" is referred to generically as "loss") has occurred in receive voice data on which reception processing has been executed by receiving section 110. If the occurrence of loss is detected, a loss flag is output to separation section 114, switching section 126, and superposition adding section 128. The loss flag indicates the voice frame in which loss occurred in the voice frame forming L-ch coded data and R-ch coded data.

Separation section 114 separates receive voice data from receiving section 110 on a channel-by-channel basis according to whether or not a loss flag is input from voice data loss detection section 112. L-ch coded data and R-ch coded data obtained by separation are output to L-ch decoding section 122 and delay section 116 respectively.

To counter the delaying of L-ch on the transmitting side, delay section 116 outputs R-ch coded data from separation section 114 to R-ch decoding section 124 delayed by one voice frame in order to align the time relationship (restore the original time relationship) between L-ch and R-ch.

The delay amount in delay processing performed by delay section 116 should preferably be implemented in voice frame units, but is not limited to one voice frame. The delay section 116 delay amount is set to the same value as the delay section 104 delay amount in voice data transmitting apparatus 10.

Also, in this embodiment, delay section 116 delays only R-ch coded data, but the way in which delay processing is executed on voice data is not limited to this as long as processing is performed that aligns the time relationship between L-ch and R-ch. For example, delay section 116 may have a configuration whereby not only R-ch coded data but also L-ch coded data is delayed, and the difference in their delay amounts is set in voice frame units. Also, if R-ch is delayed on the transmitting side, L-ch is delayed on the receiving side.

In voice decoding section 118, processing is performed to decode multi-channel voice data on a channel-by-channel basis.

In voice decoding section 118, L-ch decoding section 122 decodes L-ch coded data from separation section 114, and an L-ch decoded voice signal obtained by decoding is output. As the output side of L-ch decoding section 122 and the input side of L-ch superposition adding section 130 are constantly connected, L-ch decoded voice signal output is constantly performed to L-ch superposition adding section 130.

R-ch decoding section 124 decodes R-ch coded data from delay section 116, and an R-ch decoded voice signal obtained by decoding is output. As the output side of R-ch decoding section 124 and the input side of R-ch superposition adding section 132 are constantly connected, R-ch decoded voice signal output is constantly performed to R-ch superposition adding section 132.

When a loss flag is input from voice data loss detection section 112, switching section 126 switches the connection state of L-ch decoding section 122 and R-ch superposition adding section 132 and the connection state of R-ch decoding section 124 and L-ch superposition adding section 130 in accordance with the information contents indicated by the loss flag.

More specifically, when, for example, a loss flag is input that indicates the loss of a voice frame belonging to L-ch coded data and corresponding to frame number $K_1$, the output side of R-ch decoding section 124 is connected to the input side of L-ch superposition adding section 130 so that, of the R-ch decoded voice signals from R-ch decoding section 124, the R-ch decoded voice signal obtained by decoding the voice frame corresponding to frame number $K_1$ is output not only to R-ch superposition adding section 132 but also to L-ch superposition adding section 130.

Also, when, for example, a loss flag is input that indicates the loss of a voice frame belonging to R-ch coded data and corresponding to frame number $K_2$, the output side of L-ch decoding section 122 is connected to the input side of R-ch superposition adding section 132 so that, of the L-ch decoded voice signals from L-ch decoding section 122, the L-ch decoded voice signal obtained by decoding the voice frame corresponding to frame number $K_2$ is output not only to L-ch superposition adding section 130 but also to R-ch superposition adding section 132.

In superposition adding section 128, superposition adding processing described later herein is executed on a multi-channel decoded voice signal in accordance with a loss flag from voice data loss detection section 112. More specifically, a loss flag from voice data loss detection section 112 is input to both L-ch superposition adding section 130 and R-ch superposition adding section 132.

When a loss flag is not input, L-ch superposition adding section 130 outputs an L-ch decoded voice signal from L-ch decoding section 122 as it is. The output L-ch decoded voice signal is output after conversion to a sound wave by later-stage voice output processing (not shown) for example.

Also, when, for example, a loss flag is input that indicates the loss of a voice frame belonging to R-ch coded data and corresponding to frame number $K_2$, L-ch superposition adding section 130 outputs an L-ch decoded voice signal as it is. The output L-ch decoded voice signal is output to the above-described voice output processing stage, for example.

When, for example, a loss flag is input that indicates the loss of a voice frame belonging to L-ch coded data and corresponding to frame number $K_1$, L-ch superposition adding section 130 performs superposition addition of a concealed signal obtained by performing frame number $K_1$ frame concealment by a conventional general method using coded data or a decoded voice signal of voice frames up to frame number $K_1$-1 in L-ch decoding section 122 (an L-ch concealed signal), and an R-ch decoded voice signal obtained by decoding the voice frame corresponding to frame number $K_1$ in R-ch decoding section 124. Superposition is performed so that, for example, the L-ch concealed signal weight is large near both ends of the frame number $K_1$ frame, and the R-ch decoded signal weight is large otherwise. By this means, the L-ch decoded voice signal corresponding to frame number $K_1$ is restored, and frame concealment processing for the frame number $K_1$ voice frame (L-ch coded data) is completed. The restored L-ch decoded voice signal is output to the above-described voice output processing stage, for example.

As a superposition adding section operation, instead of using an L-ch concealed signal and R-ch decoded signal as described above, superposition addition may be performed using part of the rear end of an L-ch frame number $K_1$-1 decoded signal and the rear end of an R-ch frame number $K_1$-1 decoded signal, with the result being taken as the rear end signal of the L-ch frame number $K_1$-1 decoded signal, and frame number $K_1$ frame outputting an R-ch decoded signal as it is.

When a loss flag is not input, R-ch superposition adding section 132 outputs an R-ch decoded voice signal from R-ch decoding section 124 as it is. The output R-ch decoded voice signal is output to the above-described voice output processing stage, for example.

When, for example, a loss flag is input that indicates the loss of a voice frame belonging to L-ch coded data and corresponding to frame number $K_1$, R-ch superposition adding section 132 outputs an R-ch decoded voice signal as it is. The output R-ch decoded voice signal is output to the above-described voice output processing stage, for example.

When, for example, a loss flag is input that indicates the loss of a voice frame belonging to R-ch coded data and corresponding to frame number $K_2$, R-ch superposition adding section 132 performs superposition addition of a concealed signal obtained by performing frame number $K_2$ frame concealment using coded data or a decoded voice signal of voice frames up to frame number $K_2$-1 in R-ch decoding section 124 (an R-ch concealed signal), and an L-ch decoded voice signal obtained by decoding the voice frame corresponding to frame number $K_2$ in L-ch decoding section 122. Superposition is performed so that, for example, the R-ch concealed signal weight is large near both ends of the frame number $K_2$ frame, and the L-ch decoded signal weight is large otherwise. By this means, the R-ch decoded voice signal corresponding to frame number $K_2$ is restored, and frame concealment processing for the frame number $K_2$ voice frame (R-ch coded data) is completed. The restored R-ch decoded voice signal is output to the above-described voice output processing stage, for example.

By performing superposition addition processing as described above, it is possible to suppress the occurrence of discontinuities in decoding results between successive voice frames of the same channel.

A case will here be described in which, in the internal configuration of voice data receiving apparatus 20, a coding method is used for voice decoding section 118 that depends on the decoding state of a past voice frame, with decoding of the next voice frame being performed using that state data. In this case, when normal decoding processing is performed on the next (immediately following) voice frame after a voice frame for which loss occurred in L-ch decoding section 122, state data obtained when R-ch coded data used for concealment of that voice frame for which loss occurred is decoded by R-ch decoding section 124 may be acquired, and used for decoding of that next voice frame. This enables discontinuities between frames to be avoided. Here, normal decoding processing means decoding processing performed on a voice frame for which no loss occurred.

In this case, when normal decoding processing is performed on the next (immediately following) voice frame after a voice frame for which loss occurred in R-ch decoding section 124, state data obtained when L-ch coded data used for concealment of that voice frame for which loss occurred is decoded by L-ch decoding section 122 may be acquired, and used for decoding of that next voice frame. This enables discontinuities between frames to be avoided.

Examples of state data include (1) an adaptive codebook or LPC synthesis filter state or the like, for example, when CELP (Code Excited Linear Prediction) is used as the voice coding method, (2) predictive filter state data in predictive waveform coding such as ADPCM (Adaptive Differential Pulse Code Modulation), (3) the predictive filter state when a parameter such as a spectral parameter is quantized using a predictive quantization method, and (4) previous frame decoded waveform data when in a configuration whereby a final decoded voice waveform is obtained by performing superposition addition of decoded waveforms between adjacent frames in a transform coding method using FFT (Fast Fourier Transform), MDCT (Modified Discrete Cosine Transform), or the like, and normal voice decoding may also be performed on the next (immediately following) voice frame after a voice frame for which loss occurred using these state data.

Figure 4:
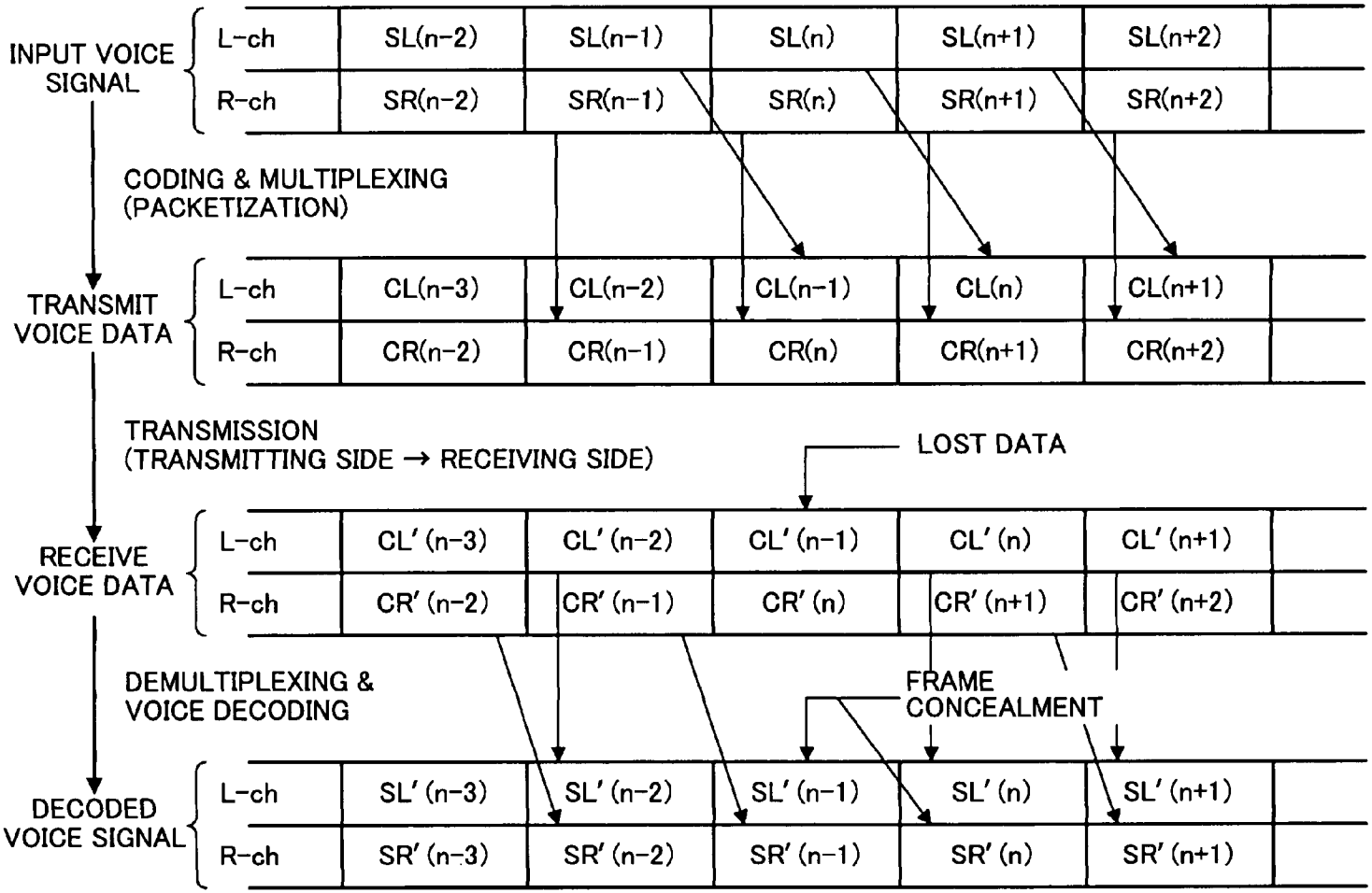
FIG. 4 is a drawing for explaining operations in a voice data transmitting apparatus and voice data receiving apparatus according to Embodiment 1 of the present invention.

Next, operations in voice data transmitting apparatus 10 and voice data receiving apparatus 20 that have the above configurations will be described. FIG. 4 is a drawing for explaining operations in voice data transmitting apparatus 10 and voice data receiving apparatus 20 according to this embodiment.

A multi-channel voice signal input to voice coding section 102 comprises an L-ch voice signal sequence and an R-ch voice signal sequence. As shown in the figure, L-ch and R-ch voice signals corresponding to the same frame number (for example, L-ch voice signal SL(n) and R-ch voice signal SR(n)) are input to voice coding section 102 simultaneously. Voice signals corresponding to the same frame number are voice signals that should ultimately undergo voice output as voice waves simultaneously.

A multi-channel voice signal undergoes processing by voice coding section 102, delay section 104, and multiplexing section 106. As shown in the figure, transmit voice data is multiplexed with L-ch coded data delayed by one voice frame relative to R-ch coded data. For example, L-ch coded data CL(n−1) is multiplexed with R-ch coded data CR(n). Voice data is packetized in this way. Generated transmit voice data is transmitted from the transmitting side to the receiving side.

Therefore, as shown in the figure, receive voice data received by voice data receiving apparatus 20 is multiplexed with L-ch coded data delayed by one voice frame relative to R-ch coded data. For example, L-ch coded data CL' (n−1) is multiplexed with R-ch coded data CR' (n).

This kind of multi-channel receive voice data undergoes processing by separation section 114, delay section 116, and voice decoding section 118, and becomes a decoded voice signal.

It will here be assumed that, in receive voice data received by voice data receiving apparatus 20, loss occurs in L-ch coded data CL' (n−1) and R-ch coded data CR' (n).

In this case, R-ch coded data CR' (n−1) having the same frame number as coded data CL' (n−1), and L-ch coded data CL(n) having the same frame number as coded data CR' (n), are received without loss, and therefore a certain level of sound quality can be secured when voice output of a multi-channel voice signal corresponding to frame number n is performed.

Furthermore, when loss occurs in coded data CL' (n−1), corresponding decoded voice signal SL' (n−1) is also lost, but since R-ch coded data CR' (n−1) of the same frame number as coded data CL' (n−1) is received without loss, decoded voice signal SL' (n−1) is restored by performing frame concealment using decoded voice signal SR' (n−1) decoded by means of coded data CR' (n−1). Also, when loss occurs in coded data CR' (n), corresponding decoded voice signal SR' (n) is also lost, but since L-ch coded data CL(n) of the same frame number as coded data CR' (n) is received without loss, decoded voice signal SR' (n) is restored by performing frame concealment using decoded voice signal SL' (n) decoded by means of coded data CL' (n). Performing this kind of frame concealment enables an improvement in restored sound quality to be achieved.

Thus, according to this embodiment, on the transmitting side, multi-channel voice data is multiplexed on which delay processing has been executed so as to delay L-ch coded data by one voice frame relative to R-ch coded data. On the other hand, on the receiving side, multi-channel voice data multiplexed with L-ch coded data delayed by one voice frame relative to R-ch coded data is separated on a channel-by-channel basis, and if loss or an error has occurred in separated coded data, one data sequence of L-ch coded data or R-ch coded data is used to conceal the loss or error in the other data sequence. Therefore, on the receiving side, at least one channel of the multiple channels can be received correctly even if loss or an error occurs in a voice frame, and it is possible to use that frame to perform frame concealment for the other channel, enabling high-quality frame concealment to be implemented.

As a voice frame of a certain channel can be restored using a voice frame of another channel, the frame concealment capability of each channel included in multiple channels can be improved. When the above-described operational effects are achieved, it becomes possible to maintain "sound directivity" implemented by a stereo signal. It is thus possible, for example, to give a sense of realism and presence to the voice of a far-end party in a conference call of the kind widely used these days between people located far apart.

In this embodiment, a configuration has been described by way of example in which data of one channel is delayed in a stage after voice coding section 102, but a configuration that enables the effects of this embodiment to be achieved is not limited to this. For example, a configuration may be used in which data of one channel is delayed in a stage prior to voice coding section 102. In this case, the set delay amount is not restricted to voice frame units, and it is possible to make the delay amount shorter than one voice frame, for example. For instance, assuming one voice frame to be 20 ms, the delay amount could be set to 0.5 voice frame (10 ms).

Embodiment 2

Figure 5:
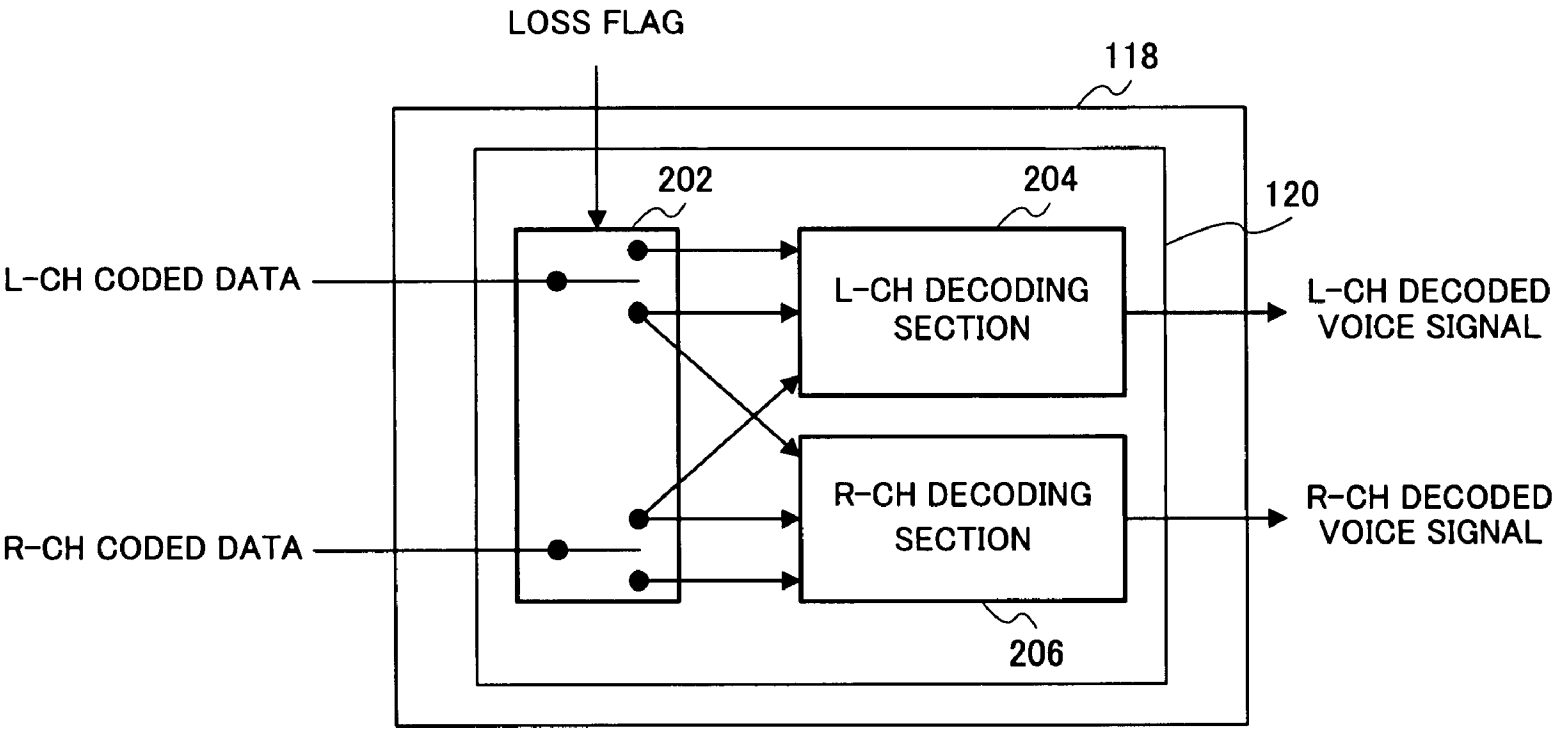
FIG. 5 is a block diagram showing the internal configuration of a voice decoding section in a voice data receiving apparatus according to Embodiment 2 of the present invention.

FIG. 5 is a block diagram showing the configuration of a voice decoding section in a voice data receiving apparatus according to Embodiment 2 of the present invention. A voice data transmitting apparatus and voice data receiving apparatus according to this embodiment have the same basic configurations as described in Embodiment 1, and therefore identical or corresponding configuration elements are assigned the same reference codes, and detailed descriptions thereof are omitted. The only difference between this embodiment and Embodiment 1 is in the internal configuration of the voice decoding section.

Voice decoding section 118 in FIG. 5 has a frame concealment section 120. Frame concealment section 120 has a switching section 202, an L-ch decoding section 204, and an R-ch decoding section 206.

When a loss flag is input from voice data loss detection section 112, switching section 202 switches the connection state of separation section 114 and R-ch decoding section 206 and the connection state of delay section 116 and L-ch decoding section 204 in accordance with the information contents indicated by the loss flag.

More specifically, when a loss flag is not input, the L-ch output side of separation section 114 is connected to the input side of L-ch decoding section 204 so that L-ch coded data from separation section 114 is output only to L-ch decoding section 204. Also, when a loss flag is not input, the output side of delay section 116 is connected to the input side of R-ch decoding section 206 so that R-ch coded data from delay section 116 is output only to R-ch decoding section 206.

When, for example, a loss flag is input that indicates the loss of a voice frame belonging to L-ch coded data and corresponding to frame number $K_1$, the output side of delay section 116 is connected to the input sides of both L-ch decoding section 204 and R-ch decoding section 206 so that, of the R-ch coded data from delay section 116, the voice frame corresponding to frame number $K_1$ is output not only to R-ch decoding section 206 but also to L-ch decoding section 204.

Also, when, for example, a loss flag is input that indicates the loss of a voice frame belonging to R-ch coded data and corresponding to frame number $K_2$, the L-ch output side of separation section 114 is connected to the input sides of both R-ch decoding section 206 and L-ch decoding section 204 so that, of the L-ch coded data from separation section 114, the voice frame corresponding to frame number $K_2$ is output not only to L-ch decoding section 204 but also to R-ch decoding section 206.

When L-ch coded data from separation section 114 is input, L-ch decoding section 204 decodes that L-ch coded data. The result of this decoding is output as an L-ch decoded voice signal. That is to say, this decoding processing is normal voice decoding processing.

Also, when R-ch coded data from delay section 116 is input, L-ch decoding section 204 decodes that R-ch coded data. Having R-ch coded data decoded by L-ch decoding section 204 in this way enables a voice signal corresponding to L-ch coded data for which loss occurred to be restored. The restored voice signal is output as an L-ch decoded voice signal. That is to say, this decoding processing is voice decoding processing for frame concealment.

When R-ch coded data from delay section 116 is input, R-ch decoding section 206 decodes that R-ch coded data. The result of this decoding is output as an R-ch decoded voice signal. That is to say, this decoding processing is normal voice decoding processing.

Also, when L-ch coded data from separation section 114 is input, R-ch decoding section 206 decodes that L-ch coded data. Having L-ch coded data decoded by R-ch decoding section 206 in this way enables a voice signal corresponding to R-ch coded data for which loss occurred to be restored. The restored voice signal is output as an R-ch decoded voice signal. That is to say, this decoding processing is voice decoding processing for frame concealment.

Thus, according to this embodiment, on the transmitting side, multi-channel voice data is multiplexed on which delay processing has been executed so as to delay L-ch coded data by one voice frame relative to R-ch coded data. On the other hand, on the receiving side, multi-channel voice data multiplexed with L-ch coded data delayed by one voice frame relative to R-ch coded data is separated on a channel-by-channel basis, and if loss or an error has occurred in separated coded data, one data sequence of L-ch coded data or R-ch coded data is used to conceal the loss or error in the other data sequence. Therefore, on the receiving side, at least one channel of the multiple channels can be received correctly even if loss or an error occurs in a voice frame, and it is possible to use that frame to perform frame concealment for the other channel, enabling high-quality frame concealment to be implemented.

Embodiment 3

Figure 6:
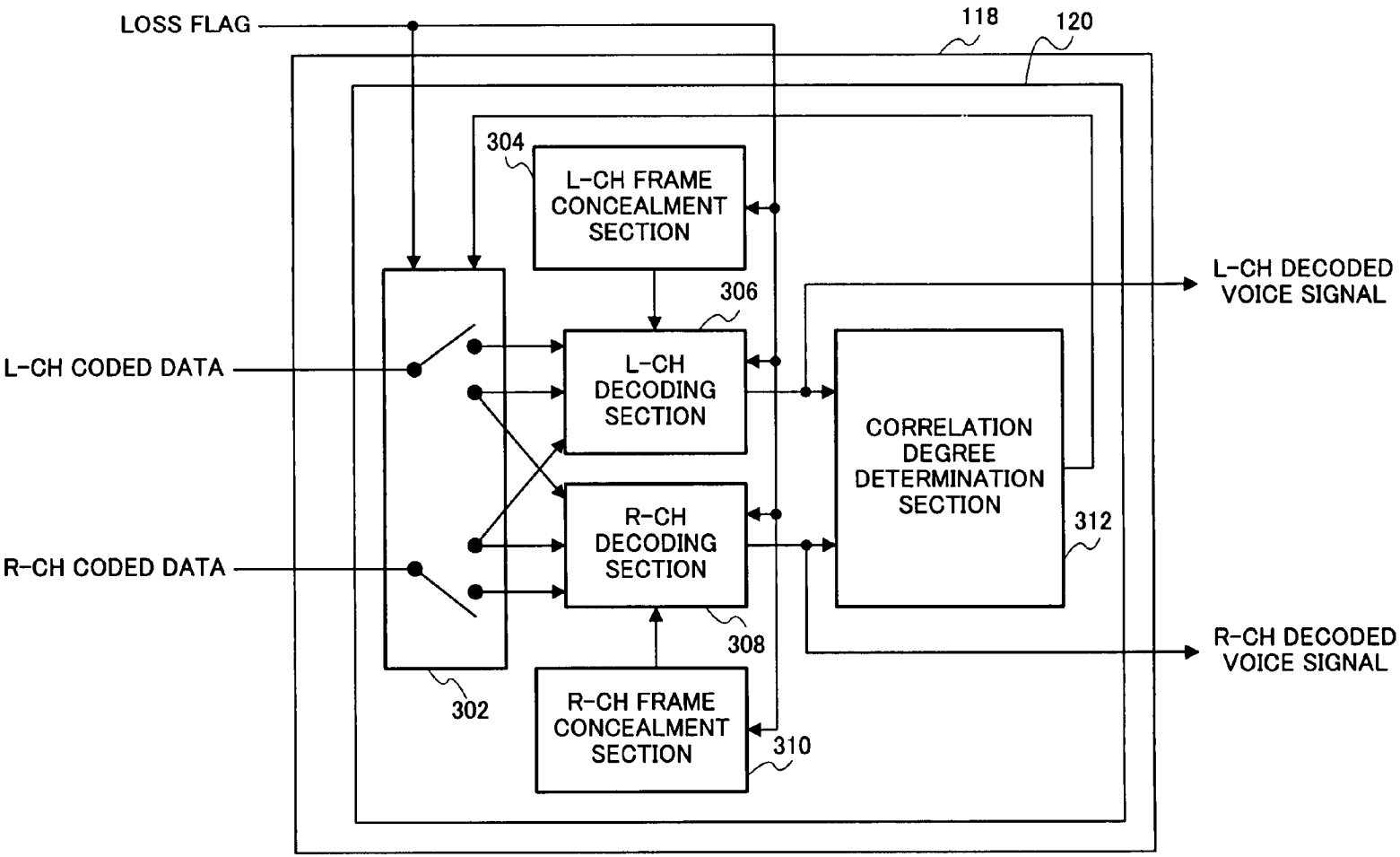
FIG. 6 is a block diagram showing the internal configuration of a voice decoding section in a voice data receiving apparatus according to Embodiment 3 of the present invention.

FIG. 6 is a block diagram showing the configuration of a voice decoding section in a voice data receiving apparatus according to Embodiment 3 of the present invention. A voice data transmitting apparatus and voice data receiving apparatus according to this embodiment have the same basic configurations as described in Embodiment 1, and therefore identical or corresponding configuration elements are assigned the same reference codes, and detailed descriptions thereof are omitted. The only difference between this embodiment and Embodiment 1 is in the internal configuration of the voice decoding section.

Voice decoding section 118 in FIG. 6 has a frame concealment section 120. Frame concealment section 120 has a switching section 302, an L-ch frame concealment section 304, an L-ch decoding section 306, an R-ch decoding section 308, an R-ch frame concealment section 310, and a correlation degree determination section 312.

Switching section 302 switches the connection state between separation section 114, and L-ch decoding section 306 and R-ch decoding section 308, according to the presence or absence of loss flag input from voice data loss detection section 112 and the information contents indicated by an input loss flag, and also the presence or absence of a directive signal from correlation degree determination section 312. Switching section 302 also switches the connection relationship between delay section 116, and L-ch decoding section 306 and R-ch decoding section 308, in a similar way.

More specifically, when a loss flag is not input, for example, the L-ch output side of separation section 114 is connected to the input side of L-ch decoding section 306 so that L-ch coded data from separation section 114 is output only to L-ch decoding section 306. Also, when a loss flag is not input, the output side of delay section 116 is connected to the input side of R-ch decoding section 308 so that R-ch coded data from delay section 116 is output only to R-ch decoding section 308.

When a loss flag is not input, as described above, connection relationships do not depend on a directive signal from correlation degree determination section 312, but when a loss flag is input, connection relationships depend on a directive signal.

For example, when a loss flag is input that indicates the loss of frame number $K_1$ L-ch coded data, if there is directive signal input the output side of delay section 116 is connected to the input sides of both L-ch decoding section 306 and R-ch decoding section 308 so that frame number $K_1$ R-ch coded data from delay section 116 is output not only to R-ch decoding section 308 but also to L-ch decoding section 306.

In contrast, if there is no directive signal input when a loss flag is input that indicates the loss of frame number $K_1$ L-ch coded data, connections between the L-ch output side of separation section 114 and L-ch decoding section 306 and R-ch decoding section 308 are cleared.

Also, when, for example, a loss flag is input that indicates the loss of frame number $K_2$ R-ch coded data, if there is directive signal input the L-ch output side of separation section 114 is connected to the input sides of both R-ch decoding section 308 and L-ch decoding section 306 so that frame number $K_2$ L-ch coded data from separation section 114 is output not only to L-ch decoding section 306 but also to R-ch decoding section 308.

In contrast, if there is no directive signal input when a loss flag is input that indicates the loss of frame number $K_2$ R-ch coded data, connections between the output side of delay section 116 and L-ch decoding section 306 and R-ch decoding section 308 are cleared.

When a loss flag indicating the loss of L-ch or R-ch coded data is input, if there is no directive signal input, L-ch frame concealment section 304 and R-ch frame concealment section 310 perform frame concealment using information up to the previous frame of the same channel, in the same way as with a conventional general method, and output concealed data (coded data or a decoded signal) to L-ch decoding section 306 and R-ch decoding section 308 respectively.

When L-ch coded data from separation section 114 is input, L-ch decoding section 306 decodes that L-ch coded data. The result of this decoding is output as an L-ch decoded voice signal. That is to say, this decoding processing is normal voice decoding processing.

Also, if there is loss flag input, when R-ch coded data from delay section 116 is input, L-ch decoding section 306 decodes that R-ch coded data. Having R-ch coded data decoded by L-ch decoding section 306 in this way enables a voice signal corresponding to L-ch coded data for which loss occurred to be restored. The restored voice signal is output as an L-ch decoded voice signal. That is to say, this decoding processing is voice decoding processing for frame concealment.

Furthermore, if there is loss flag input, when concealed data from L-ch frame concealment section 304 is input, L-ch decoding section 306 performs the following kind of decoding processing. Namely, if coded data is input as that concealed data, that coded data is decoded, and if a concealment decoded signal is input, that signal is taken directly as an output signal. In this case, also, a voice signal corresponding to L-ch coded data for which loss occurred can be restored. The restored voice signal is output as an L-ch decoded voice signal.

When R-ch coded data from delay section 116 is input, R-ch decoding section 206 decodes that R-ch coded data. The result of this decoding is output as an R-ch decoded voice signal. That is to say, this decoding processing is normal voice decoding processing.

Also, if there is loss flag input, when L-ch coded data from separation section 114 is input, R-ch decoding section 308 decodes that L-ch coded data. Having L-ch coded data decoded by R-ch decoding section 308 in this way enables a voice signal corresponding to R-ch coded data for which loss occurred to be restored. The restored voice signal is output as an R-ch decoded voice signal. That is to say, this decoding processing is voice decoding processing for frame concealment.

Furthermore, if there is loss flag input, when concealed data from R-ch frame concealment section 310 is input, R-ch decoding section 308 performs the following kind of decoding processing. Namely, if coded data is input as that concealed data, that coded data is decoded, and if a concealment decoded signal is input, that signal is taken directly as an output signal. In this case, also, a voice signal corresponding to R-ch coded data for which loss occurred can be restored. The restored voice signal is output as an R-ch decoded voice signal.

Correlation degree determination section 312 calculates the degree of correlation Cor between an L-ch decoded voice signal and an R-ch decoded voice signal using following Equation (1).

[Equation 1]

$$Cor = \sum_{i=1}^{L} sL'(-i) \cdot sR'(-i) \tag{1}$$

Here, sL' (i) and sR' (i) are respectively an L-ch decoded voice signal and an R-ch decoded voice signal. By means of above Equation (1), a degree of correlation Cor in the interval from the concealed frame voice sample value L samples before to the voice sample value one sample before (that is, the immediately preceding voice sample value) is calculated.

Correlation degree determination section 312 compares calculated degree of correlation Cor with a predetermined threshold value. If the result of this comparison is that degree of correlation Cor is higher than the predetermined threshold value, correlation between the L-ch decoded voice signal and R-ch decoded voice signal is determined to be high. Thus, when loss occurs, a directive signal for directing that reciprocal channel coded data be used is output to switching section 302.

On the other hand, if the result of the comparison between calculated degree of correlation Cor and the above-mentioned predetermined threshold value is that degree of correlation Cor is less than or equal to the predetermined threshold value, correlation between the L-ch decoded voice signal and R-ch decoded voice signal is determined to be low. Thus, when loss occurs, coded data of the same channel is used, and consequently output of a directive signal to switching section 302 is not performed.

Thus, according to this embodiment, a degree of correlation Cor between an L-ch decoded voice signal and R-ch decoded voice signal is compared with a predetermined threshold value, and whether or not frame concealment using reciprocal channel coded data is to be performed is decided according to the result of that comparison, thus enabling concealment based on reciprocal channel voice data to be performed only when inter-channel correlation is high, and making it possible to prevent degradation of concealment quality as a result of performing frame concealment using reciprocal channel voice data when the correlation is low. Also, with this embodiment, since concealment based on voice data of the same channel is performed when correlation is low, frame concealment quality can be continuously maintained.

In this embodiment, a case has been described by way of example in which correlation degree determination section 312 is provided in frame concealment section 120 according to Embodiment 2 that uses coded data for frame concealment. However, the configuration of frame concealment section 120 equipped with correlation degree determination section 312 is not limited to this. For example, the same kind of operational effects can also be achieved if correlation degree determination section 312 is provided in a frame concealment section 120 that uses decoded voice for frame concealment (Embodiment 1).

Figure 7:
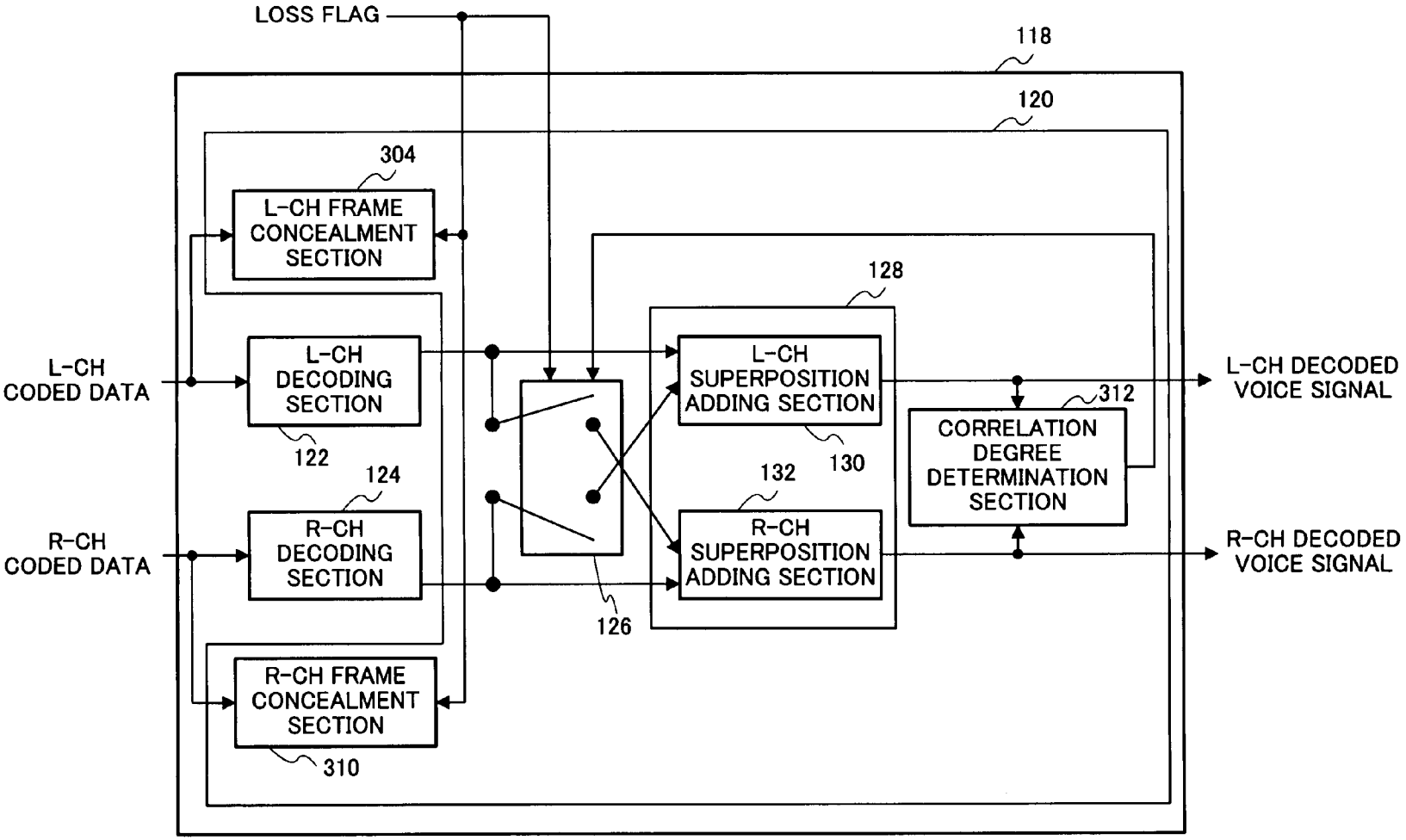
FIG. 7 is a block diagram showing a sample variant of the internal configuration of a voice decoding section in a voice data receiving apparatus according to Embodiment 3 of the present invention.

A diagram of the configuration in this case is shown in FIG. 7. Regarding operations in this case, mainly the operation of switching section 126 differs from that in the configuration in FIG. 3 according to Embodiment 1. That is to say, the connection state established by switching section 126 is switched according to a loss flag and the result of a directive signal output from correlation degree determination section 312. For example, when a loss flag is input that indicates the loss of L-ch coded data, and there is directive signal input, a concealed signal obtained by L-ch frame concealment section 304 and an R-ch decoded signal are input to L-ch superposition adding section 130, where superposition addition is performed. On the other hand, when a loss flag is input that indicates the loss of L-ch coded data, and there is no directive signal input, only a concealed signal obtained by L-ch frame concealment section 304 is input to L-ch superposition adding section 130, and is output as it is. Operations when a loss flag for R-ch coded data is input are also the same as in the above-described R-ch case.

When there is frame loss flag input, L-ch frame concealment section 304 performs frame concealment in the same way as with a conventional general method using L-ch information up to the frame before the lost frame, and outputs concealed data (coded data or a decoded signal) to L-ch decoding section 122, and L-ch decoding section 122 outputs a concealed signal of concealed frame. At this time, if coded data is input as that concealed data, decoding is performed using that coded data, and if a concealment decoded signal is input, that signal is taken directly as an output signal. When concealment processing is performed by L-ch frame concealment section 304, it is also possible for a decoded signal or state data up to the previous frame in L-ch decoding section 122 to be used, or for an output signal up to the previous frame of L-ch superposition adding section 130 to be used. The operation of R-ch frame concealment section 310 is also the same as in the L-ch case.

In this embodiment, correlation degree determination section 312 performs degree of correlation Cor calculation processing for a predetermined interval, but the correlation calculation processing method used by correlation degree determination section 312 is not limited to this.

For example, a possible method is to calculate a maximum value Cor_max of the degree of correlation between an L-ch decoded voice signal and R-ch decoded voice signal using Equation (2) below. In this case, maximum value Cor_max is compared with a predetermined threshold value, and if maximum value Cor_max exceeds that threshold value, the correlation between the channels is determined to be high. In this way, the same kind of operational effects as described above can be achieved.

Then, if the correlation has been determined to be high, frame concealment is performed using coded data of the other channel. At this time, decoded voice of the other channel used for frame concealment may be used after being shifted by a shift amount (that is, a number of voice samples) whereby maximum value Cor_max is obtained.

Voice sample shift amount τ_max that gives maximum value Cor_max is calculated using Equation (3) below. Then, when L-ch frame concealment is performed, a signal obtained by shifting the R-ch decoded signal in the positive time direction by shift amount τ_max is used. Conversely, when R-ch frame concealment is performed, a signal obtained by shifting the L-ch decoded signal in the negative time direction by shift amount τ_max is used.

[Equation 2]

$$\text{Cor_max} = \max\left\{\sum_{i=1}^{L} sL'(-i-M)\cdot sR'(-i-M-k)\right\}(k: -M \sim M) \tag{2}$$

[Equation 3]

$$\tau\text{_max} = \underset{k}{\operatorname{argmax}}\left\{\sum_{i=1}^{L} sL'(-i-M)\cdot sR'(-i-M-k)\right\}(k: -M \sim M) \tag{3}$$

In above Equation (2) and Equation (3), sL' (i) and sR' (i) are respectively an L-ch decoded voice signal and an R-ch decoded voice signal. L samples in the interval from the voice sample value L+M samples before to the voice sample value one sample before (that is, the immediately preceding voice sample value) comprise the interval subject to calculation. The shift amounts of voice samples from −M samples to M samples comprise the range subject to calculation.

By this means, frame concealment can be performed using voice data of the other channel shifted by a shift amount whereby the degree of correlation Cor is at a maximum, and inter-frame conformity between a concealed voice frame and the preceding and succeeding voice frames can be achieved more accurately.

Shift amount τ_max may be an integer value of units of a number of voice samples, or may be a fractional value that increases the resolution between voice sample values.

With regard to the internal configuration of correlation degree determination section 312, a configuration may be used that includes an amplitude correction value calculation section that uses an L-ch data sequence decoding result and R-ch data sequence decoding result to calculate an amplitude correction value for voice data of the other data sequence used for frame concealment. In this case, voice decoding section 118 is equipped with an amplitude correction section that corrects the amplitude of the decoding result of voice data of that other data sequence using a calculated amplitude correction value. Then, when frame concealment is performed using voice data of the other channel, the amplitude of that decoded signal may be corrected using that correction value. The location of the amplitude correction value calculation section need only be inside voice decoding section 118, and does not have to be inside correlation degree determination section 312.

When amplitude value correction is performed, a value of g for which D(g) in Equation (4) is a minimum is found, for example. Then the found value of g (=g_opt) is taken as the amplitude correction value. When L-ch frame concealment is performed, a signal obtained by multiplying amplitude correction value g_opt by the R-ch decoded signal is used. Conversely, when R-ch frame concealment is performed, a signal obtained by multiplying amplitude correction value reciprocal 1/g_opt by the L-ch decoded signal is used.

[Equation 4]

$$D(g) = \sum_{i=1}^{L} \{sL'(-i-M) - g \cdot sR'(-i-M-\tau_\max)\}^2 \tag{4}$$

Here, τ_max is the voice sample shift amount for which the degree of correlation Cor obtained by means of Equation (3) is at a maximum.

The amplitude correction value calculation method is not limited to Equation (4), and the following calculation methods may also be used: a) taking the value of g that gives a minimum value of D(g) in Equation (5) as the amplitude correction value; b) finding a shift amount k and value of g that give a minimum value of D (g, k) in Equation (6), and taking that value of g as the amplitude correction value; and c) taking the ratio of the square roots of the power (or average amplitude values) of L-ch and R-ch decoded signals for a predetermined interval prior to the relevant concealed frame as the correction value.

[Equation 5]

$$D(g) = \sum_{i=1}^{L} \{sL'(-i) - g \cdot sR'(-i)\}^2 \tag{5}$$

[Equation 6]

$$D(g, k) = \sum_{i=1}^{L} \{sL'(-i-M) - g \cdot sR'(-i-M-k)\}^2 \ (k: -M \sim M) \tag{6}$$

By this means, when frame concealment is performed using voice data of another channel, concealment having a more suitable amplitude can be performed by using the amplitude of that decoded signal for concealment after being corrected.

The function blocks used in the descriptions of the above embodiments are typically implemented as LSIs, which are integrated circuits. These may be implemented individually as single chips, or a single chip may incorporate some or all of them.

Here, the term LSI has been used, but the terms IC, system LSI, super LSI, and ultra LSI may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

Furthermore, in the event of the introduction of an integrated circuit implementation technology whereby LSI is replaced by a different technology as an advance in, or derivation from, semiconductor technology, integration of the function blocks may of course be performed using that technology. The adaptation of biotechnology or the like is also a possibility.

The present application is based on Japanese Patent Application No. 2004-165016 filed on Jun. 2, 2004, entire content of which is expressly incorporated herein by reference.

INDUSTRIAL APPLICABILITY

A voice data transmitting/receiving apparatus and voice data transmitting/receiving method of the present invention are suitable for use in a voice communication system or the like in which concealment processing is performed for erroneous or lost voice data.

The invention claimed is:

1. A voice data receiving apparatus comprising:

a receiving section that receives a multi channel voice data sequence that contains a first data sequence of a first channel and a second data sequence of a second channel, wherein said multi channel voice data sequence is multiplexed with said first data sequence delayed by one or more frames relative to said second data sequence;

a decoding section that decodes said received voice data sequence on a channel by channel basis;

a correlation degree calculation section that calculates a degree of correlation between a decoding result of said first data sequence, which first data sequence is obtained from a frame that is delayed by one or more frames relative to said second data sequence, and a decoding result of said second data sequence;

a comparison section that compares a calculated degree of correlation with a predetermined threshold value;

a concealment section that, if loss or an error occurs in said voice data sequence, when said voice data sequence is decoded, uses one data sequence of said first data sequence and said second data sequence to conceal said loss or error in the other data sequence; and a shift amount calculation section that calculates a voice sample shift amount that makes said degree of correlation a maximum, wherein:

said concealment section decides whether or not to perform said concealment according to a comparison result of said comparison section and performs said concealment based on a calculated shift amount when said concealment section decides to perform said concealment.

2. The voice data receiving apparatus according to claim 1, wherein:

each data sequence constitutes a sequence of voice data with a frame as a unit; and said concealment section performs said concealment by performing superposition addition of a result decoded using voice data from said other data sequence up to immediately before voice data for which said loss or error occurred belonging to said other data sequence and a decoding result of voice data belonging to said one data sequence.

3. The voice data receiving apparatus according to claim 1, further comprising:

an amplitude correction value calculation section that calculates an amplitude correction value for a decoding result of voice data of said other data sequence used for frame concealment, using a decoding result of said first data sequence and a decoding result of said second data sequence; and an amplitude correction section that corrects amplitude of a decoding result of voice data of said other data sequence using said amplitude correction value.

4. The voice data receiving apparatus according to claim 1, wherein:

each data sequence constitutes a sequence of voice data with a frame as a unit; and said decoding section, when decoding voice data positioned immediately after voice data for which said loss or error occurred among voice data belonging to said other data sequence, performs decoding using decoded state data obtained when voice data of said one data sequence used for said concealment was decoded.

5. A voice data receiving method comprising:

a receiving step of receiving a multi channel voice data sequence that contains a first data sequence of a first channel and a second data sequence of a second channel, wherein said multi channel voice data sequence is multiplexed with said first data sequence delayed by one or more frames relative to said second data sequence;

a decoding step of decoding said received voice data sequence on a channel by channel basis;

a correlation degree calculation step of calculating a degree of correlation between a decoding result of said first data sequence, which first data sequence is obtained from a frame that is delayed by one or more frames relative to said second data sequence, and a decoding result of said second data sequence;

a comparison step of comparing a calculated degree of correlation with a predetermined threshold value;

a concealment step of, if loss or an error occurs in said voice data sequence, when said voice data sequence is decoded, using one data sequence of said first data sequence and said second data sequence to conceal said loss or error in the other data sequence; and a shift amount calculation step of calculating a voice sample shift amount that makes said degree of correlation a maximum, wherein:

said concealment step decides whether or not to perform said concealment according to a comparison result of said comparison step and performs said concealment based on a calculated shift amount when said concealment step decides to perform said concealment.

* * * * *

UNITED STATES PATENT AND TRADEMARK OFFICE

CERTIFICATE OF CORRECTION

PATENT NO. : 8,209,168 B2
APPLICATION NO. : 11/628045
DATED : June 26, 2012
INVENTOR(S) : Koji Yoshida It is certified that error appears in the above-identified patent and that said Letters Patent is hereby corrected as shown below:

Claim 3, column 17, line 11, incorrectly reads:

"frame concealment, using a decoding result of said first"

and should read:

"frame concealment using a decoding result of said first"

Signed and Sealed this
Eighteenth Day of December, 2012

David J. Kappos

David J. Kappos
*Director of the United States Patent and Trademark Office*